US011542823B2

(12) United States Patent
Luo et al.

(10) Patent No.: US 11,542,823 B2
(45) Date of Patent: Jan. 3, 2023

(54) COOLING DEVICE FOR TURBINE NOZZLE GUIDE VANE BY LIQUID METAL WITH LOW MELTING POINT

(71) Applicant: Beihang University, Beijing (CN)

(72) Inventors: Xiang Luo, Beijing (CN); Zhe Zhang, Beijing (CN); Zeyu Wu, Beijing (CN)

(73) Assignee: Beihang University, Beijing (CN)

( * ) Notice: Subject to any disclaimer, the term of this patent is extended or adjusted under 35 U.S.C. 154(b) by 0 days.

(21) Appl. No.: 17/555,648

(22) Filed: Dec. 20, 2021

(65) Prior Publication Data

US 2022/0228492 A1 Jul. 21, 2022

(30) Foreign Application Priority Data

Jan. 21, 2021 (CN) ..... 202110082035.4

(51) Int. Cl.
*F01D 5/18* (2006.01)
*F01D 9/04* (2006.01)

(52) U.S. Cl.
CPC ..... *F01D 5/181* (2013.01); *F01D 9/041* (2013.01); *F05D 2240/126* (2013.01);
(Continued)

(58) Field of Classification Search
CPC .... F01D 5/181; F01D 9/041; F05D 2240/126; F05D 2240/128; F05D 2260/205;
(Continued)

(56) References Cited

U.S. PATENT DOCUMENTS 5,782,076 A * 7/1998 Huber ..... F02C 7/224 415/115
6,295,803 B1 * 10/2001 Bancalari ..... F02C 7/08 415/114

(Continued)

FOREIGN PATENT DOCUMENTS

CN 108825311 11/2018
FR 2769341 A1 * 4/1999 ..... F01D 5/088

OTHER PUBLICATIONS

First Office Action from the State Intellectual Property Office of China for Application No. 202110082035.4 dated Aug. 30, 2021 (12 pages).

*Primary Examiner* — Courtney D Heinle
*Assistant Examiner* — Danielle M. Christensen
(74) *Attorney, Agent, or Firm* — Amundsen Davis LLC

(57) ABSTRACT

Disclosed is a cooling device for a turbine nozzle guide vane with a low-melting-point metal as a flowing working media. A plurality of cooling channels and a cavity are arranged in a guide vane. The cooling device includes a flow divider, a collector, a radiator and an electromagnetic pump, the cooling device and the guide vane form a closed loop. Liquid low-melting-point metal or alloy thereof as the flowing working medium is driven by the electromagnetic pump to circularly flow in the closed loop and dissipate rapidly through the radiator. Air cooling is not adopted in the present disclosure, cooling air originally led out from a gas compressor is saved so as to increase the propelling power of an aircraft. Air film holes do not need to be formed in the outer surface of the guide vane so as to improve strength of the guide vane.

19 Claims, 4 Drawing Sheets

(52) U.S. Cl.
CPC .. *F05D 2240/128* (2013.01); *F05D 2260/205* (2013.01); *F05D 2260/213* (2013.01); *F05D 2260/22141* (2013.01); *F05D 2260/232* (2013.01)

(58) Field of Classification Search
CPC ..... F05D 2260/213; F05D 2260/232; F05D 2260/22141
See application file for complete search history.

(56) References Cited

U.S. PATENT DOCUMENTS

| | | | |
|---|---|---|---|
| 8,789,377 | B1 | 7/2014 | Brostmeyer et al. |
| 2019/0153953 | A1 | 5/2019 | Niergarth et al. |

* cited by examiner

COOLING DEVICE FOR TURBINE NOZZLE GUIDE VANE BY LIQUID METAL WITH LOW MELTING POINT

CROSS REFERENCE TO RELATED APPLICATION

This patent application claims the benefit and priority of Chinese Patent Application 202110082035.4 filed on Jan. 21, 2021, the disclosure of which is incorporated by reference herein in its entirety as part of the present application.

TECHNICAL FIELD

The present disclosure relates to a cooling device for a turbine nozzle guide vane of an aviation gas turbine engine, in particular to a cooling device for a turbine nozzle guide vane with a low-melting-point metal or an alloy of the low-melting-point metals as a flowing working media.

BACKGROUND ART

Aviation gas turbine engines need to achieve design goals by increasing total pressure ratio and turbine inlet temperature in order to improve thrust-to-weight ratio and thermal efficiency. Especially, the efficiency of the engine is directly affected by the increase of the turbine inlet temperature. At present, the turbine inlet temperature reaches up to 1800-2050 K, and under such high temperature, higher requirements are provided for the heat resistance of all parts of a turbine. On one hand, new heat-resistant materials need to be developed; on the other hand, protective measures need to be taken for hot section components through advanced cooling techniques.

For a turbine nozzle, it mainly includes an annular static vane cascade consisting of an inner ring, an outer ring and a guide vane of the turbine nozzle, and converts a part of heat energy of combustion gas flow passing through the turbine nozzle into kinetic energy and discharge the gas flow in a certain manner, so as to meet the inlet airflow direction required by the working turbine. However, the working conditions of the turbine nozzle are very severe, a first-stage turbine nozzle is connected to the outlet of a combustion chamber, the guide vane is surrounded by gas flow and exposed to high and non-uniform temperature, therefore, the guide vane is easy to burn. Furthermore, the guide vane is in direct contact with high-temperature combustion gas; therefore, material selection, structure and cooling modes must be considered in the design process.

According to a traditional cooling mode, secondary flow introduced from the combustion chamber are used for cooling the first-stage turbine nozzle and a second-stage turbine nozzle of the turbine, and the cooled air flows are converged with a mainstream air flow. Specifically, air film cooling is adopted on the outer surface of the guide vane, cooperating with a cooling mode and turbulent flow columns and other structures in the guide vane. However, all of the introduced cooling air is led out from an air compressor, so that the opportunity of doing work is lost in order to meet the cooling requirement, and the heat efficiency and the doing work capacity of the engine are greatly reduced. Furthermore, under the condition that the cooling air does not participate in a thermodynamic cycle, heat is absorbed from the main combustion gas flow in the thermal protection process of high-temperature parts, so that heat loss in the main combustion gas flow is aggravated; unstable flow of gas flow is easily caused after the cooling air is mixed with the main flow, so that aerodynamic loss of the main combustion gas flow is increased.

SUMMARY

In consideration of the factors above, the following ideas are proposed: if gas for cooling the guide vane is saved, secondary air is not introduced from an air compressor any more, and other working media with high heat exchange efficiency are adopted to circularly flow, then the heat efficiency and the doing work capacity of the engine can be improved, the cooling effect can be enhanced and the service life of the guide vane can be prolonged. The metals have the heat conductivity far higher than that of other non-metal materials, a special metal is still in a liquid state at a normal temperature or even at a temperature as high as 2000° C. The special metal can be used as a high-heat-conductivity flowing working medium to flow in the guide vane by utilizing the excellent heat exchange capacity to take away heat of the guide vane, so as to cool the guide vane. Based on the comprehensive consideration, the cooling device which can be used for taking away a large amount of heat from a guide vane of an aviation gas turbine engine is provided, thereby achieving cooling with cyclic utilization of working media and better cooling effect.

It is provided a cooling device for a turbine nozzle guide vane with a low-melting-point metal or an alloy of the low-melting-point metal as a flowing working media. A plurality of cooling channels are arranged in a guide vane. A cavity is reserved at a bottom in the guide vane. Each cooling channel communicates with the cavity, some of the plurality of cooling channels are inflow guide vane cooling channels, and a rest of the plurality of cooling channels are outflow guide vane cooling channels. The cooling device for a turbine nozzle guide vane includes:

a flow divider in which a first circulation channel is formed; the first circulation channel is filled with the flowing working medium, a plurality of flow divider pipelines are arranged on a side of the flow divider, a number, sizes and shapes of the plurality of flow divider pipelines are matched with a number, sizes and shapes of the inflow guide vane cooling channels, and the flow divider is correspondingly connected with the inflow guide vane cooling channels in the guide vane through the plurality of flow divider pipelines;

a collector in which a second circulation channel is formed in the collector, the second circulation channel is filled with the flowing working medium, a plurality of collector pipelines are arranged on a side of the collector, a number and shapes of the plurality of collector pipelines are matched with a number and shapes of the outflow guide vane cooling channels, and the collector is correspondingly connected with the outflow guide vane cooling channels in the guide vane through the plurality of collector pipelines;

an electromagnetic pump communicated with the flow divider through a first connecting pipeline and configured for driving the flowing working media to flow; and a radiator correspondingly communicated with the electromagnetic pump and the collector through a second connecting pipeline and a third connecting pipeline, the second connecting pipeline penetrates through the radiator and is communicated with the third connecting pipeline, and the radiator is configured for rapidly radiating and cooling the flowing working media with heat flowing out of the guide vane.

The flowing working medium is a liquid low-melting-point metal or an alloy thereof; the flow divider, the guide vane, the collector, the radiator and the electromagnetic pump form a closed loop, and the electromagnetic pump drives the flowing working media to flow in the closed loop.

In some embodiments, cross-section shapes of the flow divider and the collector are square, rectangular, triangular or circular.

In some embodiments, the flow divider and the collector are made of metals or high-temperature-resistant alloy materials.

In some embodiments, cross-section shapes of the first connecting pipeline, the second connecting pipeline and the third connecting pipeline are square, rectangular, triangular or circular.

In some embodiments, the first connecting pipeline, the second connecting pipeline and the third connecting pipeline are made of metals or high-temperature-resistant alloy materials.

In some embodiments, the flowing working medium is low-melting-point metal gallium which is melted at room temperature, or an alloy composed of the metal gallium and a matrix selected from tin, bismuth or indium.

In some embodiments, each cooling channel in the guide vane is a ribbed cooling channel.

In some embodiments, a cross-section shape of each cooling channel in the guide vane is square, rectangular, triangular or circular.

In some embodiments, cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

In some embodiments, a size of the cavity of the guide vane is slightly larger than sizes of the plurality of cooling channels of the guide vane, such that the flowing working media of the inflow guide vane cooling channels and the outflow guide vane cooling channels are converged in the cavity to form an anticlockwise closed loop.

The cooling device for a turbine nozzle guide vane of the present disclosure is different from an existing traditional cooling mode in which air film cooling is adopted on the outer surface of a guide vane, cooperating air flowing in the cooling channels in the guide vane. The cooling device for a turbine nozzle guide vane includes a flow divider, a collector, a radiator and an electromagnetic pump, and forms the closed loop together with the guide vane. The liquid low-melting-point metal or the alloy of the low-melting-point metal is adopted as the flowing working media, the flowing working media is driven by the electromagnetic pump to circulate in the cooling channels in the guide vane, and the characteristic that the heat conductivity of the metals or the alloys of the metals is far higher than that of non-metal materials is fully utilized. Furthermore, the working media can circularly flow in the closed loop, and the guide vane can be cooled efficiently through taking away a large amount of heat in the guide vane rapidly by the radiator. Air cooling is not adopted in the present disclosure, cooling air originally led out from a gas compressor is saved to increase the propelling power of an aircraft. The cooling effect of the present disclosure is far better than that of a gas cooling mode in a traditional process, has high heat transfer efficiency and larger temperature drop on the guide vane, thereby prolonging the service life of the guide vane. In the present disclosure, air film holes do not need to be formed in the outer surface of the guide vane so that the strength of the guide vane is improved; and the whole process is cyclically closed, the low-melting-point metal or the alloy thereof is recycled, which has no influence on the environment.

The foregoing as well as other objects, advantages, and features of the present disclosure become more apparent to those skilled in the art from the following detailed description of specific embodiments of the present disclosure taken in conjunction with the attached figures.

BRIEF DESCRIPTION OF THE DRAWINGS

Some specific embodiments of the present disclosure are hereinafter described in detail in an exemplary or non-restrictive mode with reference to the accompanying drawings. Same reference signs in the drawings indicate same or similar components or parts. Those skilled in the art should understand that the drawings are not necessarily drawn to scale.

List of reference numbers: 1 flow divider; 2, flow divider pipeline; 3 first connecting pipeline; 4 electromagnetic pump; 5 second connecting pipeline; 6 radiator; 7 third connecting pipeline; 8 collector pipeline; 9 collector; 10 guide vane; 11 inflow guide vane cooling channel; 12 outflow guide vane cooling channel; and 13 cavity; 14 first circulation channel and 15 second circulation channel.

DETAILED DESCRIPTION OF THE EMBODIMENTS

Figure 1:
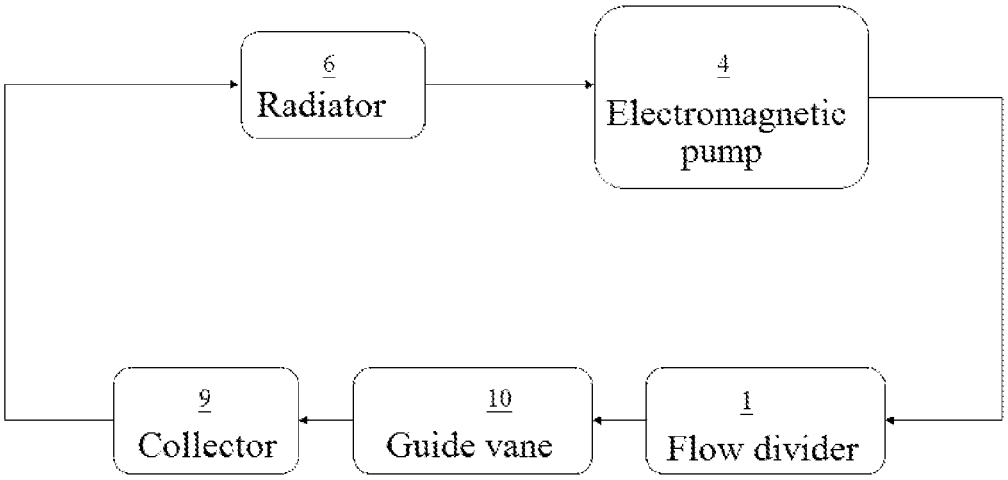
FIG. 1 is a schematic logic control diagram of a cooling device for a turbine nozzle guide vane with a low-melting-point metal as a flowing working media according to one embodiment of this disclosure.
Figure 2:
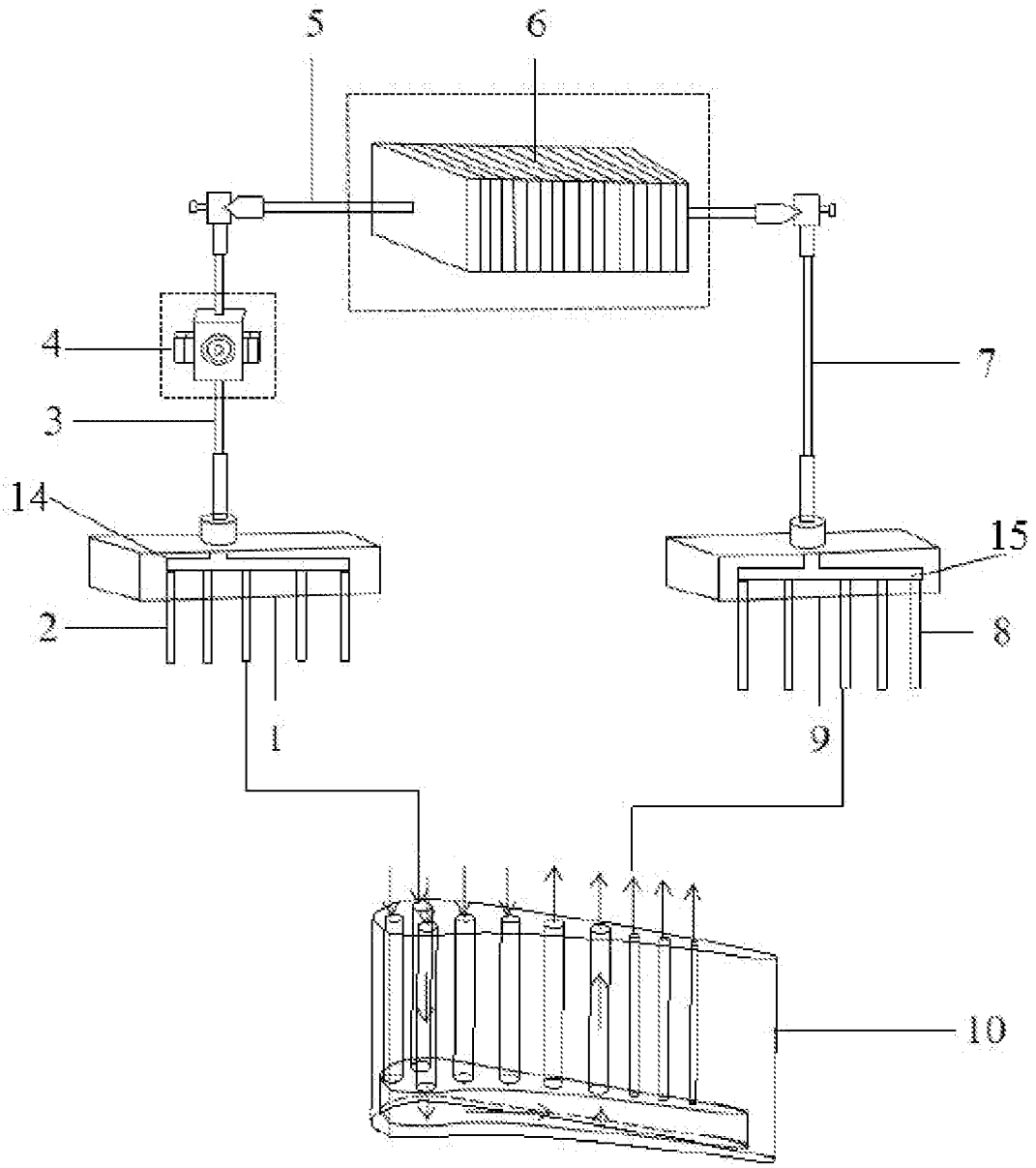
FIG. 2 is a schematic structural diagram of the cooling device for a turbine nozzle guide vane with the low-melting-point metal in an outer portion of an outer ring of a guide vane as the flowing working media.
Figure 3:
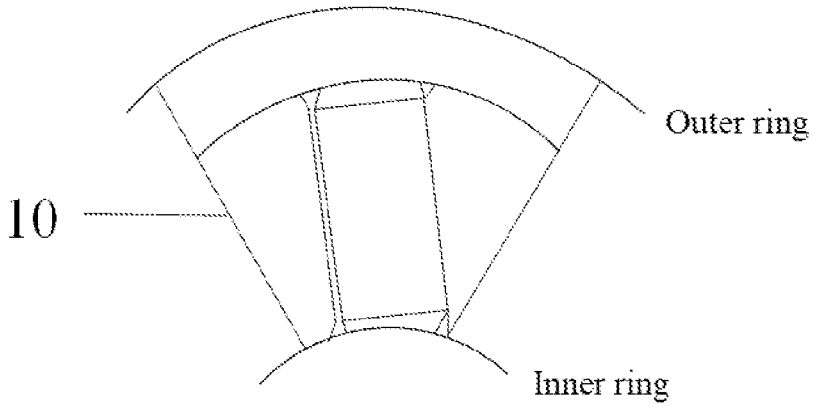
FIG. 3 is a schematic structural diagram of the guide vane.
Figure 4:
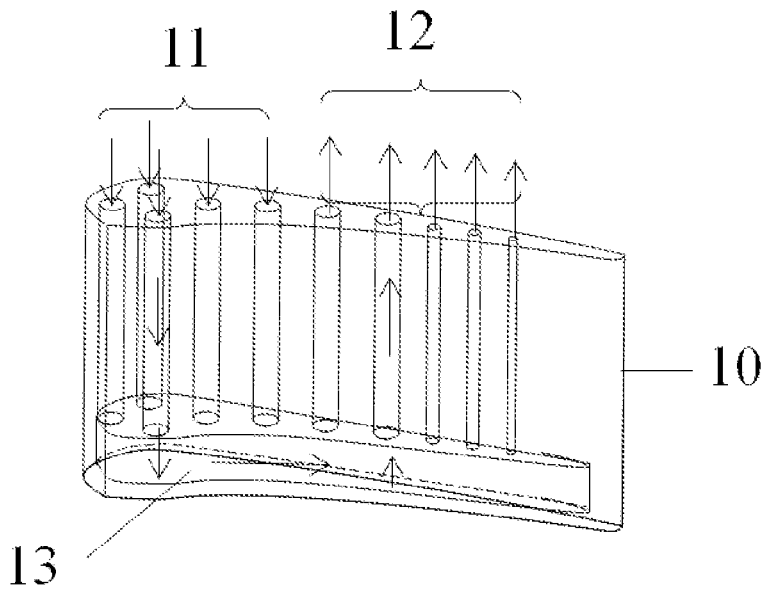
FIG. 4 is a schematic perspective view of the guide vane.

FIG. 1 is a schematic logic control diagram of a cooling device for a turbine nozzle guide vane with a low-melting-point metal as a flowing working media according to one embodiment of this disclosure. FIG. 2 is a schematic structural diagram of the cooling device for a turbine nozzle guide vane with the low-melting-point metal at an outer portion of an outer ring of a guide vane as the flowing working media. FIG. 3 is a schematic structural diagram of the guide vane. FIG. 4 is a schematic perspective view of the guide vane.

As shown in FIG. 4, in the embodiment, a plurality of cooling channels are arranged in the guide vane 10. A cavity 13 is provided at a bottom inside the guide vane 10. Each cooling channel communicates with the cavity 13. Some of the plurality of cooling channels are inflow guide vane cooling channels 11, and the rest of the plurality of cooling channels are outflow guide vane cooling channels 12. As shown in FIG. 1, referring to FIG. 2 to FIG. 4, the embodiment provides a cooling device for a turbine nozzle guide vane with low-melting-point metals or alloys of the low-melting-point metals as flowing working media. Generally, the cooling device for a turbine nozzle guide vane includes a flow divider 1, a collector 9, a radiator 6 and an electromagnetic pump 4. A first circulation channel 14 is formed in the flow divider 1, and the first circulation channel 14 is filled with a flowing working medium. A plurality of flow divider pipelines 2 are arranged on one side of the flow divider 1. Each flow divider pipeline 2 communicates with the first circulation channel 14 of the flow divider 1. The number, the sizes and the shapes of the flow divider pipelines 2 are matched with the number, the sizes and the shapes of the inflow guide vane cooling channels 11. The flow divider pipelines 2 of the flow divider 1 are correspondingly connected with the inflow guide vane cooling channels 11 in the guide vane 10. A second circulation channel 15 is formed in the collector 9, the second circulation channel is filled with a flowing working medium. A plurality of collector pipelines 8 are arranged on one side of the collector 9. Each collector pipeline 8 communicates with the second circulation channel 15 of the collector 9. The number and the shapes of the collector pipelines 8 are matched with the number and the shapes of the outflow guide vane cooling channels 12. The collector pipelines 8 of the collector 9 are correspondingly connected with the outflow guide vane cooling channels 12 in the guide vane 10. The electromagnetic pump 4 communicates with the flow divider 1 through a first connecting pipeline 3 and is mainly used for driving the flowing working medium to flow. The radiator 6 correspondingly communicates with the electromagnetic pump 4 and the collector 9 through a second connecting pipeline 5 and a third connecting pipeline 7. The second connecting pipeline 5 passes through the radiator 6 and communicates with the third connecting pipeline 7. The radiator 6 is mainly used for rapidly radiating and cooling the flowing working media with heat flowing out of the guide vane 10. Each flowing working media, namely the flowing working medias in the flow divider 1 and the collector 9, is liquid low-melting-point metals or alloys of the low-melting-point metals. The flowing working media is returned to the flow divider 1 through the flow divider 1, the guide vane 10, the collector 9, the radiator 6 and the electromagnetic pump 4 to form a closed loop, and the electromagnetic pump 4 drives the flowing working media to flow in the closed loop.

During specific implementation, the electromagnetic pump 4 is installed on the second connecting pipeline 5 so as to drive the low-melting-point metal or the alloy of the low-melting-point metal as the flowing working media to flow in the second connecting pipeline 5. The electromagnetic pump 4 is mainly used for driving the low-melting-point metal or the alloy of the low-melting-point metal as the working media to flow in the whole closed loop, the shape of the electromagnetic pump 4 is suitable as long as the size thereof is as small as possible and the electromagnetic pump 4 is suitable for being installed in the space of an outer duct. When the second connecting pipeline 5 is manufactured, the circulation channel can be reserved in the middle thereof through machining or other mature technologies, then one end of the second connecting pipeline 5 is connected with the radiator 6, and the other end of the second connecting pipeline 5 is connected with the first connecting pipeline 3. The length of the second connecting pipeline 5 and the length of the first connecting pipeline 3 can be adjusted according to the outer ring space as required, and the length is as short as possible under the condition that the requirements are met.

During specific implementation, the radiator 6 is installed on the second connecting pipeline 5, so that low-melting-point metal or alloy of the low-melting-point metal as flowing working media can be cooled at the cold end more efficiently, and a backflow circulation is achieved. During manufacturing, two ends of the radiator are provided with connection openings with diameters equal to the pipe diameter of the second connecting pipeline 5, through machining or other methods, so as to enable the second connecting pipeline 5 to connect with the third connecting pipeline 7. The radiator 6 includes a large number of fins, the shape of the radiator 6 is suitable as long as the volume thereof is as small as possible and the radiator 6 is suitable for being installed in the space of the outer duct. The fins are made of conventional materials. During use, cold air passing through the outer duct passes through the radiator 6, the fins are subjected to convection heat exchange with air, a part of heat is taken away, the low-melting-point metal or the alloy flowing through the second connecting pipeline 5 is efficiently cooled at the cold end, and then the low-melting-point metal or alloy flows into the next device. The lengths of the second connecting pipeline 5 and the third connecting pipeline 7 can be adjusted according to the space of the outer ring as required, and are as short as possible under the condition that the requirements are met.

The working process of this disclosure is as follows.

As shown in FIG. 2, during actual operation, the low-temperature low-melting-point metal or the alloy of the low-melting-point metal is used as the flowing working media, the flowing working media flow into the inflow guide vane cooling channels 11 of the guide vane 10 from the circulation channel of the flow divider 1 through the flow divider pipelines 2, and the low-temperature low-melting-point metal or the alloy of the low-melting-point metal rapidly transfer and carry heat of the high-temperature guide vane 10, and then the low-temperature low-melting-point metal or the alloy is converged in the cavity 13 reserved at the bottom of the guide vane 10, then flows out of the guide vane 10 from the outflow guide vane cooling channels 12 of the guide vane 10, and enters the collector 9 through the collector pipelines 8. And then, the low-temperature low-melting-point metal or the alloy reaches the radiator 6 through the third connecting pipeline 7 and the second connecting pipeline 5. Heat of the low-melting-point metal or the alloy of the low-melting-point metal is taken away by air in the outer duct through fins of the radiator 6, and the cooled low-melting-point metal or the alloy of the low-melting-point metal continuously flow through the electromagnetic pump 4 and reaches the flow divider 1 through the first connecting pipeline 3, so that a whole closed circulation loop is formed; and the next cycle is prepared to start and so on. The method has a good cooling effect on the guide vane 10, and the introduction of the low-melting-point metal or the alloy of the low-melting-point metal is equivalent to directly transferring the heat of the guide vane 10 to the outside of the outer ring and then discharging the heat, so that the method is simple to operate and efficient in cooling.

The working principle of this disclosure is as follows.

The cooling device for a turbine nozzle guide vane provided by this disclosure is substantially different from a traditional cooling device in selection of the flowing working media, namely, the low-melting-point metal or the alloy of the low-melting-point metal is used as the flowing working media for the first time for cooling the guide vane 10 (no same method is reported in domestic and foreign documents and patents so far). When the cooling device for a turbine nozzle guide vane is connected with the guide vane, heat transfer is efficient and rapid because the low-melting-point metal or the alloy of the low-melting-point metal has much higher heat conductivity and diffusivity than those of the non-metallic fluid, and the absorbed heat can be quickly transferred away through the flow of the low-temperature low-melting-point metal or the alloy. Meanwhile, all low-melting-point metal or the alloy of the low-melting-point metal flowing through the cooling channels in the guide vane 10 are converged in the collector 9, and reach the radiator 6 through the third connecting pipeline 7 via the circulation channel of the collector 9. Due to the unique structure of the fins of the radiator 6, the low-melting-point metal or the alloy of the low-melting-point metal carrying a large amount of heat exchanges heat with the air through convection in the outer space of the outer ring, and the heat is dissipated and cooled. In conclusion, the extremely high heat conductivity of the low-melting-point metal or the alloy of the low-melting-point metal as the flowing working media can ensure that the heat of the guide vane 10 is transferred out, and compared with conventional air cooling or other liquid such as water and other non-low-melting-point metals, the flowing working media are low in heat conductivity and unstable at high temperature. Due to the introduction of the low-melting-point metal or the alloy of the low-melting-point metal as the flowing working media, the heat of the guide vane 10 is efficiently and feasibly taken away in a convection heat exchange mode in which the low-melting-point metal or the alloy of the low-melting-point metal is used as the flowing working media. In addition, the heat exchange effect with the outer ring space environment is enhanced through the radiator 6, and the cooling efficiency is improved. Due to the existence of the electromagnetic pump 4, a certain pressure difference can be generated in the circulation channel, under the action of the pressure difference, the low-melting-point metal or the alloy of the low-melting-point metal is used as the flowing working media to circularly flow in the whole closed loop, and after the heat of the low-melting-point metal or alloy of the low-melting-point metal as the flowing working media, carried from the interior of the guide vane in a primary circulation is released in the outer space of the outer ring, it becomes the low-temperature flowing working media. Therefore, new heat transport is continued, and the working media start to flow in cycles.

In conclusion, the cooling device for a turbine nozzle guide vane is different from an existing traditional cooling mode that air film cooling is adopted on the outer surface of a guide vane and air flows in the cooling channel in the guide vane, the cooling device for a turbine nozzle guide vane includes the flow divider 1, the collector 9, the radiator 6 and the electromagnetic pump 4, and the cooling device for a turbine nozzle guide vane and the guide vane 10 form the closed loop. The liquid low-melting-point metal or the alloy thereof is adopted as the flowing working media, the flowing working media is driven by the electromagnetic pump 4 to circulate in the cooling channels in the guide vane 10, and the characteristic that the heat conductivity of the metal or the alloy thereof is far higher than that of the non-metal material is fully utilized; meanwhile, the working media can circularly flow in the closed loop, and a large amount of heat in the guide vane 10 can be rapidly taken away through the radiator 6, so that the effect of efficiently cooling the guide vane 10 is achieved. According to the cooling device for a turbine nozzle guide vane with the low-melting-point metal as the flowing working media, air cooling is not adopted, cooling air originally led out from a gas compressor is saved to increase the propelling power of an aircraft. The cooling effect is far better than that of a gas cooling mode in a traditional process, the heat transfer efficiency is high, and the temperature drop of the guide vane 10 is larger, so that the service life of the guide vane 10 is prolonged. Air film holes do not need to be formed in the outer surface of the guide vane 10, and the strength of the guide vane is improved. The whole process is cyclically closed, the low-melting-point metal or the alloy thereof is recycled, which has on influence on the environment.

As shown in FIG. 2, specifically, the flow divider 1 and the collector 9 are diversified in external shapes, and the cross-section shapes of the flow divider 1 and the collector 9 can be square, rectangular, triangular or circular. More specifically, the flow divider 1 and the collector 9 are mainly used for distributing the flowing working media entering the inflow guide vane cooling channels 11 inside the guide vane 10 and collecting the flowing working media from the outflow guide vane cooling channels 12 inside the guide vane 10, the flowing working media after passing through the radiator 6 and the electromagnetic pump 4 again forms a closed loop, and is ready for a next circular flowing. In principle, all circulation channels can be used as their structure. The structural forms of the circulation channels can be prepared according to requirements, and various forms can be combined. Preferably, the whole set of device is in a ring shape so as to adapt to the space structure of the inner ring and the outer ring.

As shown in FIG. 2, specifically, the flow divider 1 and the collector 9 are made of metals or high-temperature-resistant alloy materials.

As shown in FIG. 2, specifically, the cross-section shapes of the first connecting pipeline 3, the second connecting pipeline 5 and the third connecting pipeline 7 are square, rectangular, triangular or circular.

As shown in FIG. 2, specifically, the first connecting pipeline 3, the second connecting pipeline 5 and the third connecting pipeline 7 are made of metals or high-temperature-resistant alloy materials.

More specifically, as shown in FIG. 4, each cooling channel in the guide vane 10 is a ribbed cooling channel.

Further, the cross-section shape of each cooling channel in the guide vane 10 is square, rectangular, triangular or circular.

More specifically, the cooling channels at the front end of the interior of the guide vane 10 are the inflow guide vane cooling channels 11, the cooling channels at the rear end of the interior of the guide vane 10 are the outflow guide vane cooling channels 12, and the cooling channels form an anticlockwise closed flowing space for the flowing working media through the cavity 13.

More specifically, the shape of the cavity 13 reserved at the bottom in the guide vane 10 is not limited, and the size of the cavity 13 of the guide vane 10 is slightly larger than the sizes of the cooling channels of the guide vane 10, so that the flowing working media of the inflow guide vane cooling channels 11 and the outflow guide vane cooling channels 12 are converged to form an anticlockwise closed loop. Specifically, the upper surface area of the cavity 13 is larger than the outer surface area formed by the cross sections of the cooling channels, the arc of the outer surface of the cavity 13 is reduced in proportion to the shape of the guide vane 10, but the minimum reduced arc length of the arc of the outer surface of the cavity 13, in particular the minimum reduced arc at the front edge position is slightly larger than the circumscribed circle of the first three cooling channels.

In order to achieve a good cooling effect, the low-melting-point metals or the alloys of the low-melting-point metals as the flowing working media generally used in the present disclosure should meet the following requirements: the flowing working media is non-toxic, does not have corrosion and chemical effects on contact materials, and has a slow chemical reaction at a high temperature of about 2000° C.; the flowing working media is convenient to acquire; the flowing working media is of certain thermal stability; the specific heat, the heat conductivity and the heat diffusivity are high, so that when certain heat is transferred, the flow is small, and the heat transfer is rapid; the low-melting-point metals or the alloys of the low-melting-point metals as the flowing working media should be compatible with a structural material of the cooling device, and the low-melting-point metals or the alloys of the low-melting-point metals as the flowing working media should not cause adverse factors such as corrosion and rusting to parts of the cooling device. In addition, the low-melting-point metals or the alloys of the low-melting-point metals as the flowing working media should also have a large latent heat of fusion and a small viscosity coefficient. For example, even though the melting point of sodium which is also a liquid metal is 97.82° C. and the melting point of potassium is 63.2° C., sodium and potassium are not suitable for cooling the guide vane, mainly because sodium and potassium are very prone to chemically react with water and the metal activity is too strong; and in addition, for example, although the melting point of mercury is very low and is −38.87° C., mercury is not suitable for being taken as a working medium of this disclosure due to toxicity.

Specifically, as shown in FIG. 2, each flowing working medium, namely the flowing working medium flowing in the flow divider 1, the collector 9, the first connecting pipeline 3, the second connecting pipeline 5 and the third connecting pipeline 7, is low-melting-point gallium metal which can be melted at room temperature, or is an alloy of gallium metal and tin, bismuth or indium as a base. The alloy can also be an alloy formed by three metals of Ga, In and Sn according to a certain proportion.

A key point of the present disclosure is that the low-melting-point metals or the alloys of the low-melting-point metals are introduced as the flowing working media for transmitting heat, namely, the flowing working media flowing in the cooling channels in the guide vane 10, the first connecting pipeline 3, the second connecting pipeline 5 and the third connecting pipeline 7 are not conventionally used water or other liquid, but the metal such as gallium or an alloy of gallium that can keep a liquid state from normal temperature to 2000° C., and the low-melting-point metal has the heat conductivity and the heat diffusivity far higher than those of non-metal and has fluidity, so that heat can be quickly and efficiently transported. Compared with a conventional method of using gas or non-metal liquid as a flowing working medium, the method of the present disclosure is an innovation. Currently, although the melting points of many metals such as mercury are relatively low, a relatively suitable low-melting-point metal in view of safety and stability is gallium, gallium is a soft silvery white metal with a very low melting point in atmospheric environment of only 29.77° C., a boiling point of 204.8° C., a latent heat of fusion of 19.16 cal/g, a density of 5904 g/cm$^3$ in a solid state, and a density of 6.093 g/m$^3$ in a liquid state at 32.38° C. The specific heat of solid gallium at 27° C. is 0.089 ca/g*° C., and the linear expansion coefficient of solid gallium is $18.1*10^{-6}$/° C. from 0° C. to the melting point; the volume is reduced when gallium is molten; the heat conductivity coefficient of liquid gallium at the melting point is 25.2 kcal/m*h*° C., and is much higher than that of air and water; the specific heat of liquid gallium at 100° C. is 0.082 cal/g*° C.; the absolute viscosity of liquid gallium is $1.89*10^{-2}$ g/cm*s at 529° C. and $1.03*10^{-2}$ g/cm*s at 301° C.; and these thermal properties indicate that gallium is very suitable as a cooling medium for cooling the guide vane. At normal temperature, gallium is stable in air, when the temperature is 260° C. or above, dried oxygen can oxidize gallium metal, but a generated oxide film can prevent the gallium metal from being continuously oxidized; therefore, the gallium-based cooling device has good stability and reliability. In atomic reactors, liquid gallium has also been used as a heat carrier. It is worth noting that gallium can form low-melting-point alloys with many metals such as bismuth, tin and indium. For example, a gallium alloy with 8% tin has a melting point of 20° C., and a gallium alloy with 25% indium melts at 16° C. Further, by adopting a multi-component mixture, it is also possible to obtain a metal fluid with a wider melting point with 62.5% Ga, 21.5% In and 16% Sn, the mixture has a melting point of 10.7° C., and the three-component eutectice vaporate mixture with 69.8% Ga, 17.6% In and 12.6% Sn has a melting point of 10.8° C. The melting point of the alloy composed of Ga, In and Sn is lower, and the temperature of $GaIn_{25}Sn_{13}$ is lower to 5° C., so that the alloy can also be used as a cooling medium and even has better performance. The alloys can be used as the working media in this disclosure. Therefore, the low-melting-point metals or the alloys of the low-melting-point metals have much higher heat-conducting capacity and heat-absorbing capacity than those of traditional heat-conducting agents such as methyl alcohol and water, and are novel ideal heat transfer media. As long as an electromagnetic pump 4 is arranged in the connecting pipeline, the low-melting-point metals or the alloys of the low-melting-point metals in the cooling channels in the guide vane, the first connecting pipeline 3, the second connecting pipeline 5 and the third connecting pipeline 7 can be driven to flow. Furthermore, in order to quickly dissipate heat from the low-melting-point metals or the alloys of the low-melting-point metals carrying heat from the guide vane 10 for the next cycle, the radiator 6 is also arranged in the second connecting pipeline 5 for efficient heat dissipation. Moreover, even if the flow of the low-melting-point metals or the alloys of the low-melting-point metals is stopped, the heat is transferred from the guide vane 10 to the radiator 6 by using the high heat conductivity of the low-melting-point metals or the alloys of the low-melting-point metals, and the heat dissipation function can be fully realized, so that the service life of the guide vane 10 is prolonged.

At present, compared with a turbine inlet temperature which is increased by 20° C. annually for an aviation gas turbine engine, the heat resistance of the material of the guide vane 10 which is increased by 8° C. annually still cannot meet the requirement for increasing the initial temperature of gas, and the cooling mode of the guide vane 10 is urgently changed. The circulating loop device which takes the low-melting-point metals or the alloys of the low-melting-point metals as flowing working media and combines the electromagnetic pump 4 and the radiator 6 into a whole is a technology with a novel concept, and is a breakthrough for efficiently cooling the guide vane 10.

It is noted that technical or scientific terms used herein are to be taken in ordinary meanings as understood by one of those skilled in the art to which the present disclosure pertains unless otherwise indicated.

In the description of the present disclosure, it needs to be illustrated that the indicative direction or position relations of the terms such as "center", "longitudinal", "transverse", "length", "width", "thickness", "upper", "lower", "front", "rear", "left", "right", "vertical", "horizontal", "top", "bottom", "inside", "outside", "clockwise", "anti-clockwise", "axial", "radial" and "circumferential" are direction or position relations illustrated based on the attached figures, just for facilitating the description of the present disclosure and simplifying the description, but not for indicating or hinting that the indicated device or element must be in a specific direction and is constructed and operated in the specific direction, the terms cannot be understood as the restriction of the present disclosure.

In addition, the terms "first" and "second" are merely intended for a purpose of description, and shall not be understood as an indication or implication of relative importance or implicit indication of the number of indicated technical features. In the description of the present disclosure, the meaning of "a plurality of" means two or more unless expressly specifically defined otherwise.

In this disclosure, except as otherwise noted, the terms such as "install", "link" and "connect" should be generally understood, for example, the components can be fixedly connected, and also can be detachably connected or integrally connected; the components can be mechanically connected, and also can be electrically connected; the components can be directly connected and also can be indirectly connected through an intermediate, and two components can be communicated internally or interact with each other. For any person skilled in the art, the specific meanings of the terms in the present disclosure can be understood according to specific conditions.

In this disclosure, unless expressly specified and limited otherwise, a first feature being "over" or "under" a second feature can mean that the first and second features are in direct contact or that the first and second features are in indirect contact through a medium. Moreover, a first feature being "over," "above" and "on" a second feature can be the first feature being directly above or obliquely above the second feature, or simply mean that the first feature is at a higher level than the second feature. A first feature being "under", "below" and "underneath" a second feature can be the first feature being directly below or obliquely below the second feature, or simply mean that the first feature is at a smaller level than the second feature.

The foregoing descriptions are merely example specific implementations of this disclosure, but are not intended to limit the protection scope of this disclosure. Any variation or replacement readily figured out by persons skilled in the art within the technical scope disclosed in this disclosure shall fall within the protection scope of this disclosure. Therefore, the protection scope of this disclosure shall be subject to the protection scope of the claims.

What is claimed is:

1. A cooling device for a turbine nozzle guide vane with a low-melting-point metal or an alloy of the low-melting-point metal as a flowing working media, wherein a plurality of cooling channels are arranged in a guide vane , a cavity is reserved at a bottom in the guide vane, each cooling channel communicates with the cavity, some of the plurality of cooling channels are inflow guide vane cooling channels, and a rest of the plurality of cooling channels are outflow guide vane cooling channels; and the cooling device for the turbine nozzle guide vane comprises:

a flow divider in which a first circulation channel is formed, wherein the first circulation channel is filled with the flowing working medium, a plurality of flow divider pipelines are arranged on a side of the flow divider, a number, sizes and shapes of the plurality of flow divider pipelines are matched with a number, sizes and shapes of the inflow guide vane cooling channels, and the flow divider is correspondingly connected with the inflow guide vane cooling channels in the guide vane through the plurality of flow divider pipelines;

a collector in which a second circulation channel is formed in the collector, the second circulation channel is filled with the flowing working medium, a plurality of collector pipelines are arranged on a side of the collector, a number and shapes of the plurality of collector pipelines are matched with a number and shapes of the outflow guide vane cooling channels, and the collector is correspondingly connected with the outflow guide vane cooling channels in the guide vane through the plurality of collector pipelines;

an electromagnetic pump communicated with the flow divider through a first connecting pipeline and configured for driving the flowing working media to flow; and a radiator correspondingly communicated with the electromagnetic pump and the collector through a second connecting pipeline and a third connecting pipeline, the second connecting pipeline penetrates through the radiator and is communicated with the third connecting pipeline, and the radiator is configured for rapidly radiating and cooling the flowing working media with heat flowing out of the guide vane;

wherein the flowing working medium is a liquid low-melting-point metal or an alloy thereof; the flow divider, the guide vane, the collector, the radiator and the electromagnetic pump form a closed loop, and the electromagnetic pump drives the flowing working media to flow in the closed loop.

2. The cooling device for the turbine nozzle guide vane according to claim 1, wherein cross-section shapes of the flow divider and the collector are square, rectangular, triangular or circular.

3. The cooling device for the turbine nozzle guide vane according to claim 2, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

4. The cooling device for the turbine nozzle guide vane according to claim 3, wherein a size of the cavity of the guide vane is slightly larger than sizes of the plurality of cooling channels of the guide vane, such that the flowing working media of the inflow guide vane cooling channels and the outflow guide vane cooling channels are converged in the cavity to form an anticlockwise closed loop.

5. The cooling device for the turbine nozzle guide vane according to claim 1, wherein the flow divider and the collector are made of metals or high-temperature-resistant alloy materials.

6. The cooling device for the turbine nozzle guide vane according to claim 5, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

7. The cooling device for the turbine nozzle guide vane according to claim 6, wherein a size of the cavity of the guide vane is slightly larger than sizes of the plurality of cooling channels of the guide vane, such that the flowing working media of the inflow guide vane cooling channels and the outflow guide vane cooling channels are converged in the cavity to form an anticlockwise closed loop.

8. The cooling device for the turbine nozzle guide vane according to claim 1, wherein cross-section shapes of the first connecting pipeline, the second connecting pipeline and the third connecting pipeline are square, rectangular, triangular or circular.

9. The cooling device for the turbine nozzle guide vane according to claim 8, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

10. The cooling device for the turbine nozzle guide vane according to claim 9, wherein a size of the cavity of the guide vane is slightly larger than sizes of the plurality of cooling channels of the guide vane, such that the flowing working media of the inflow guide vane cooling channels and the outflow guide vane cooling channels are converged in the cavity to form an anticlockwise closed loop.

11. The cooling device for the turbine nozzle guide vane according to claim 1, wherein the first connecting pipeline, the second connecting pipeline and the third connecting pipeline are made of metals or high-temperature-resistant alloy materials.

12. The cooling device for the turbine nozzle guide vane according to claim 11, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

13. The cooling device for the turbine nozzle guide vane according to claim 1, wherein the flowing working medium is low-melting-point metal gallium which is melted at room temperature, or an alloy composed of the metal gallium and a matrix selected from tin, bismuth or indium.

14. The cooling device for the turbine nozzle guide vane according to claim 13, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

15. The cooling device for the turbine nozzle guide vane according to claim 1, wherein a cross-section shape of each cooling channel in the guide vane is square, rectangular, triangular or circular.

16. The cooling device for the turbine nozzle guide vane according to claim 15, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

17. The cooling device for the turbine nozzle guide vane according to claim 1, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

18. The cooling device for the turbine nozzle guide vane according to claim 17, wherein a size of the cavity of the guide vane is slightly larger than sizes of the plurality of cooling channels of the guide vane, such that the flowing working media of the inflow guide vane cooling channels and the outflow guide vane cooling channels are converged in the cavity to form an anticlockwise closed loop.

19. The cooling device for the turbine nozzle guide vane according to claim 1, wherein cooling channels at an inner front end of the guide vane are the inflow guide vane cooling channels, cooling channels at an inner rear end of the guide vane are the outflow guide vane cooling channels, and the plurality of cooling channels form an anticlockwise closed flowing space for the flowing working media through the cavity.

* * * * *